US008312993B2

(12) United States Patent
Sams et al.

(10) Patent No.: US 8,312,993 B2
(45) Date of Patent: Nov. 20, 2012

(54) CONTAINER FOR HOUSING A TRAY OR BLISTER PACK

(75) Inventors: Stephen Sams, Bassingbourn (GB); Anthony Fraser, Rutland (GB)

(73) Assignee: MeadWestvaco Corporation, Richmond, VA (US)

( * ) Notice: Subject to any disclaimer, the term of this patent is extended or adjusted under 35 U.S.C. 154(b) by 0 days.

(21) Appl. No.: 12/921,799

(22) PCT Filed: Mar. 12, 2009

(86) PCT No.: PCT/US2009/036877

§ 371 (c)(1),
(2), (4) Date: Sep. 10, 2010

(87) PCT Pub. No.: WO2009/114654

PCT Pub. Date: Sep. 17, 2009

(65) Prior Publication Data

US 2011/0011875 A1 Jan. 20, 2011

(30) Foreign Application Priority Data

Mar. 14, 2008 (GB) ..... 0804831.6

(51) Int. Cl.
*B65D 83/04* (2006.01)
*B65D 81/00* (2006.01)

(52) U.S. Cl. ..... 206/531; 206/528; 206/468

(58) Field of Classification Search ..... 206/531, 206/528, 232, 532, 538, 468, 1.5, 570, 530
See application file for complete search history.

(56) References Cited

U.S. PATENT DOCUMENTS

| | | | | |
|---|---|---|---|---|
| 3,429,426 | A * | 2/1969 | Weller et al. | 206/531 |
| 3,659,706 | A * | 5/1972 | Serrell | 206/539 |
| 5,109,984 | A * | 5/1992 | Romick | 206/531 |
| 5,549,204 | A * | 8/1996 | Toren | 206/539 |
| 5,988,429 | A * | 11/1999 | Coe | 221/25 |
| 6,021,901 | A * | 2/2000 | Wolfe | 206/531 |
| 6,349,831 | B1 * | 2/2002 | Buss | 206/531 |
| 6,752,272 | B2 * | 6/2004 | Jones et al. | 206/534 |
| 7,658,287 | B2 | 2/2010 | Hession | |
| 7,798,328 | B2 * | 9/2010 | Hession | 206/531 |
| 2004/0040880 | A1 | 3/2004 | Grosskopf | |
| 2006/0131205 | A1 | 6/2006 | Sandberg et al. | |
| 2007/0227931 | A1 | 10/2007 | Shane | |
| 2007/0272586 | A1 * | 11/2007 | Hession | 206/532 |
| 2008/0023352 | A1 | 1/2008 | Creed | |
| 2009/0045078 | A1 * | 2/2009 | Gelardi et al. | 206/1.5 |
| 2009/0057189 | A1 * | 3/2009 | Silvenis et al. | 206/570 |
| 2010/0096292 | A1 * | 4/2010 | Jones | 206/531 |
| 2010/0230320 | A1 * | 9/2010 | Caron et al. | 206/531 |

FOREIGN PATENT DOCUMENTS

| | | |
|---|---|---|
| DE | 8016422 | 11/1980 |
| EP | 0559167 | 9/1993 |
| FR | 2553987 | 5/1985 |
| FR | 2862291 | 5/2005 |
| GB | 2355256 | 4/2001 |
| WO | WO2004037657 | 5/2004 |
| WO | WO2005049448 | 2/2005 |
| WO | WO2005028316 | 3/2005 |

(Continued)

*Primary Examiner* — Steven A. Reynolds
(74) *Attorney, Agent, or Firm* — MWV Intellectual Property Group

(57) ABSTRACT

A container is disclosed for housing a tray or blister pack. The container includes a shell (40) with an internal volume for holding the tray or blister pack, and a cover (10) with a base (11), hinge (13), and lid (12) for enclosing the shell (40).

16 Claims, 15 Drawing Sheets

FOREIGN PATENT DOCUMENTS

| | | |
|---|---|---|
| WO | WO2005030606 | 4/2005 |
| WO | WO2007021788 | 2/2007 |
| WO | WO2008112876 | 9/2008 |
| WO | WO2008124622 | 10/2008 |
| WO | WO2009013471 | 1/2009 |
| WO | WO2009029255 | 3/2009 |

* cited by examiner

FIG. 8A
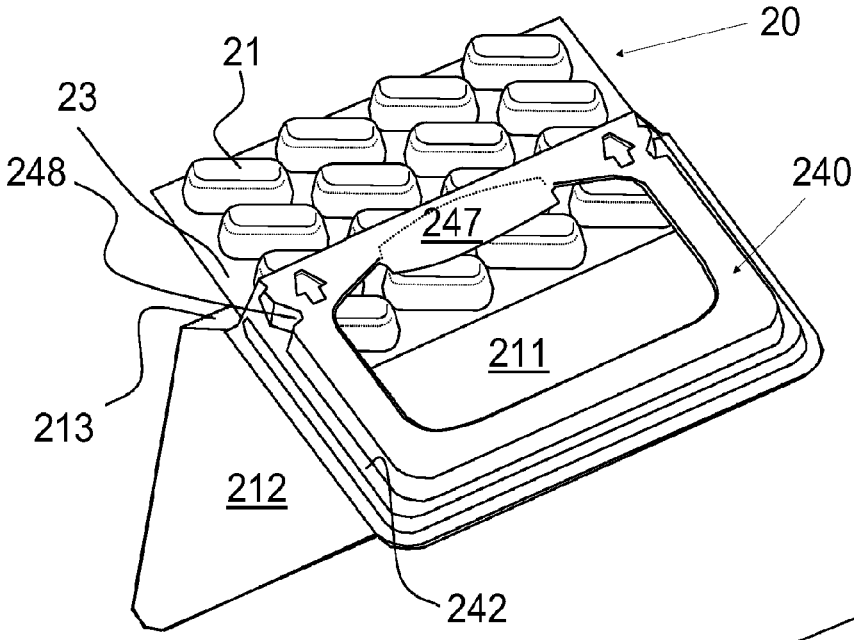
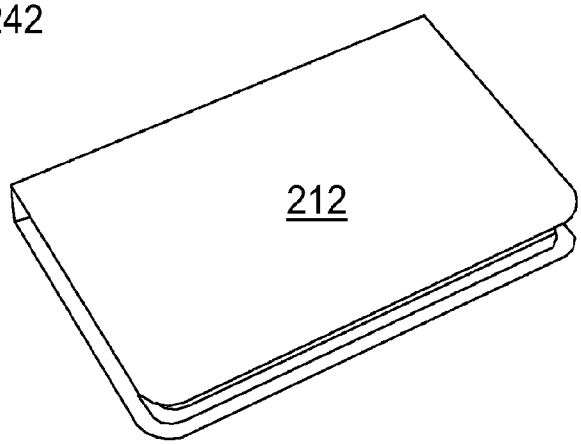
FIG. 8B

FIG. 10A
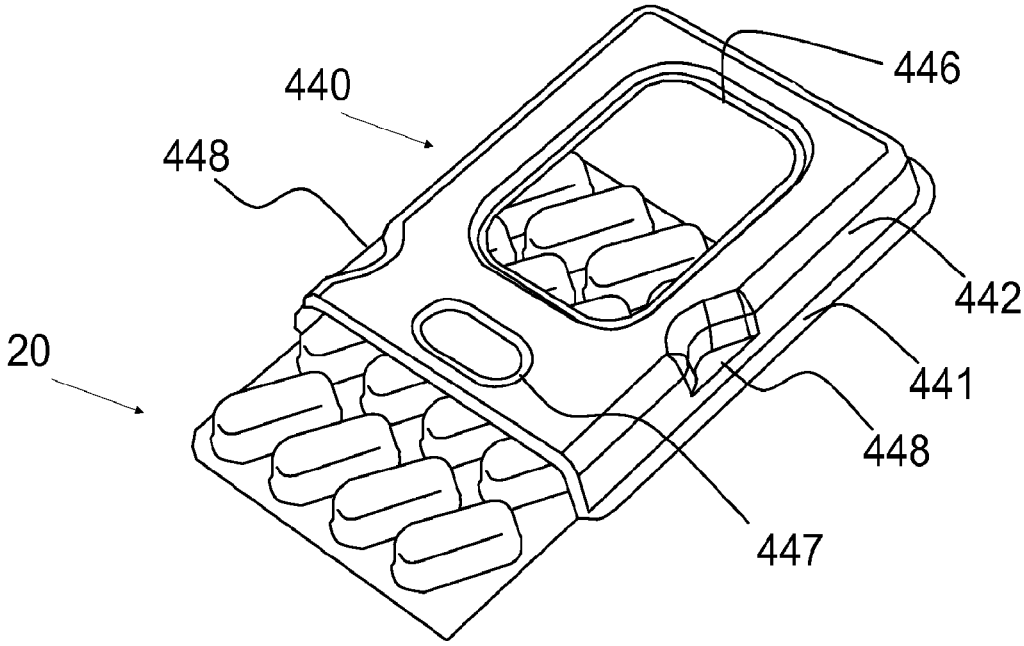
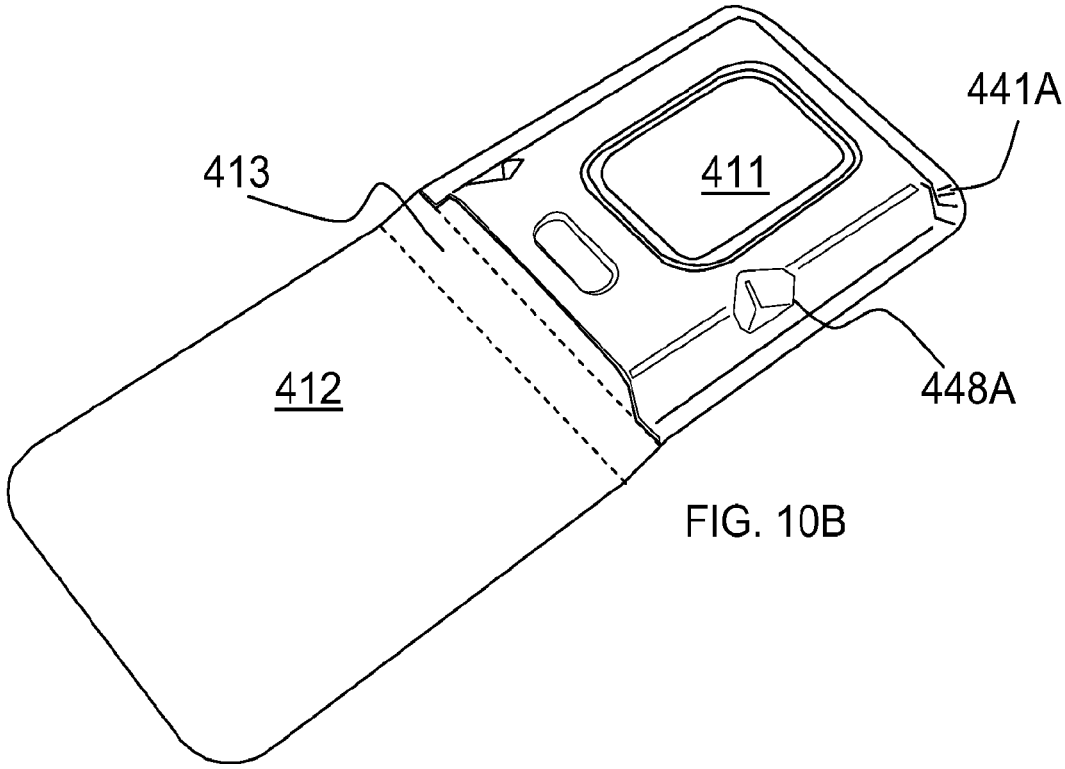
FIG. 10B

FIG. 14A
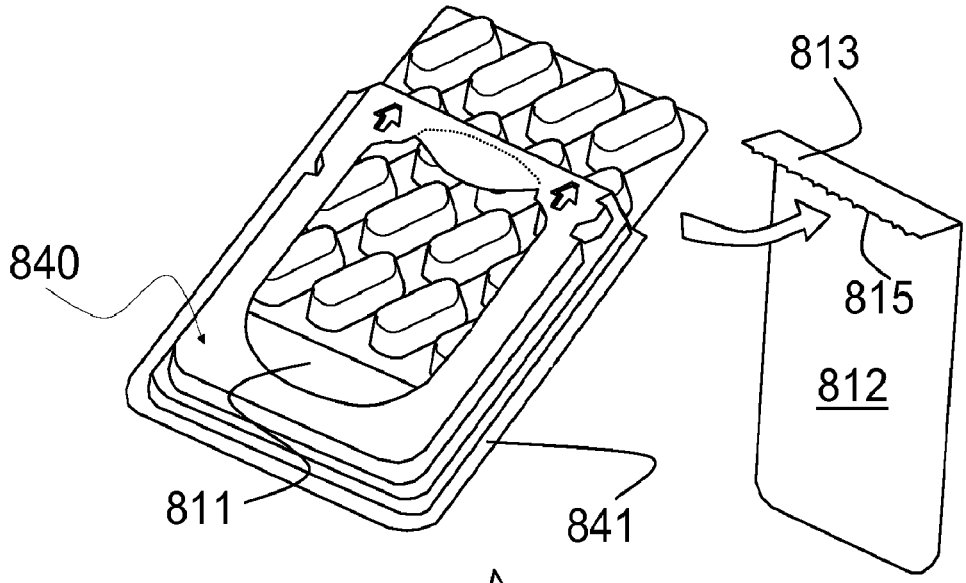
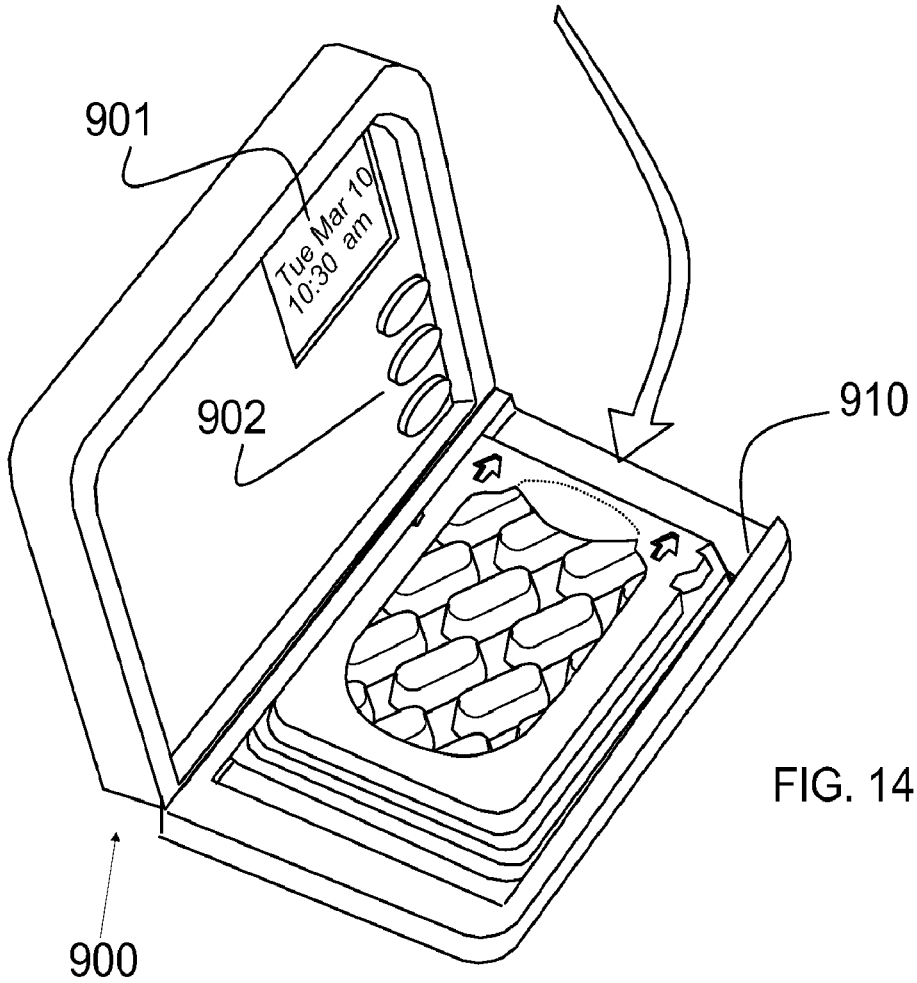
FIG. 14B

CONTAINER FOR HOUSING A TRAY OR BLISTER PACK

This disclosure relates to a container and, more particularly, a booklet-style container for enclosing a tray or blister pack.

A wide variety of containers are known for holding blister packs, e.g. containing an array of pills. Commonly, the blister pack is enclosed in a carton, e.g. a cardboard container one end of which opens to enable the blister pack to be inserted therein and removed therefrom. Similarly there are containers for holding other objects such as medical devices, for example syringes, where the syringes may be held in thermoformed trays or tray structures made of paperboard.

A tray or blister pack may also be provided in a plastic sleeve which is closed on three sides but open at one end. Examples of such sleeves are described in WO2004/037657, WO2005/030606 and WO2005/049448.

These containers suffer from various disadvantages: provisions for the display of compliance information (or other information) and/or the housing of a leaflet or booklet may be limited or inconvenient, and their manufacture requires the use of a relatively large amount of paperboard or plastic material in order to form a sturdy container. Some containers provide additional functionality such as devices to retain blister packs, but in turn require specialized blister packs.

For simplicity in this disclosure, a blister pack is often used as an example of a structure that may be housed in the disclosed container or containers; however, trays or tray-like structures may be housed in the container as well.

This invention seeks to provide a new form of container which addresses these disadvantages and also provides for one or more of the following:

a) provide a slim, sturdy container for conveniently dispensing standard blister packs or other tray-like structures, b) provide convenient surfaces on which to print instructions, and c) be relatively easy and inexpensive to manufacture.

A blister pack generally comprises a generally planar side formed by a foil (typically of aluminium) and a plastic layer having one or more blisters moulded therein. Each blister comprises an enclosure with an open side which is covered by the foil. Articles (such as pills) housed in said blisters can be ejected through the foil by pressing the relevant blister. Perforations may be provided in the foil in the area of each blister to facilitate rupture of a localised area of the foil as an article is ejected from a blister.

Besides blister packs, other tray-like structures are used to hold items. For examples, medical devices such as syringes may be held in thermoformed trays or trays constructed of folded paperboard.

According to one embodiment of the invention, there is provided a container for housing a tray or blister pack and for dispensing one or more articles from the tray or blister pack, the container comprising a base portion, a lid portion, and a hinge portion connecting the base portion to the lid portion and about which the lid portion and/or base portion are movable between an open configuration and a closed configuration, the base portion having a shell attached thereto for receiving a tray or blister pack, the shell having an open end and being adapted to enable sliding of the tray or blister pack relative thereto in a direction substantially parallel to said base portion between a storage position and one or more dispensing positions.

According to another embodiment of the invention, there is provided a container for housing a tray or blister pack and for dispensing one or more articles from the tray or blister pack, the container comprising a base portion, a lid portion, and a hinge portion connecting the base portion to the lid portion and about which the lid portion and/or base portion are movable between an open configuration and a closed configuration, the base portion having a shell attached thereto for receiving a tray or blister pack, the shell having an open end and being adapted to enable sliding of the tray or blister pack relative thereto in a direction substantially parallel to said base portion between a storage position and one or more dispensing positions, and the lid portion having a frame attached thereto which mates with said shell when the container is in a closed configuration, the base or lid portion having a tab to close the open end of the container.

According to another embodiment of the invention, there is provided a container for housing a tray or blister pack and for dispensing one or more articles from the tray or blister pack, the container comprising a base portion, a lid portion, and a hinge portion connecting the base portion to the lid portion and about which the lid portion and/or base portion are movable between an open configuration and a closed configuration, the base portion having a shell attached thereto for receiving a tray or blister pack, the shell having an open end and being adapted to enable sliding of the tray or blister pack relative thereto in a direction substantially parallel to said base portion between a storage position and one or more dispensing positions, and the lid portion having a frame attached thereto which mates with said shell when the container is in a closed configuration, the frame having a gate portion to close the open end of the container.

According to another embodiment of the invention, there is provided a container for housing a tray or blister pack and for dispensing one or more articles from the tray or blister pack, the dispenser comprising a base portion, a lid portion, and a hinge portion connecting the base portion to the lid portion and about which the lid portion and/or base portion are movable between an open configuration and a closed configuration, the base portion having a shell attached thereto for receiving a tray or blister pack, the shell having an open end and being adapted to enable sliding of the tray or blister pack relative thereto in a direction substantially parallel to said base portion between a storage position and one or more dispensing positions, wherein the hinge portion is adjacent to the open end and covers the open end when the container is in a closed configuration.

According to another embodiment of the invention, there is provided a container for housing two trays or blister packs. According to another embodiment of the invention, the container has a tear off hinge and lid thereby providing a shell and base that may be inserted into a monitoring device.

As will be described further below, the container provides several advantages over prior art containers such as those mentioned above. In certain embodiments, a standard blister pack can be accommodated, that is, having no special features other than conventional blisters mounted on a planar substrate with at least a portion of some edges extending beyond the blisters. In certain embodiments, shell of the container may incorporate detents, tabs, or other devices that have a loose interference fit with the blisters themselves or with other features of the tray or blister pack so as to allow the tray or blister pack to be indexed by steps out of the shell. In certain embodiments, the shell is provided with an access area by which to move the tray or blister pack out of or into the shell. In certain embodiments, portions of the shell may be formed to allow a close sliding fit with the edges of the tray or blister pack to provide a smooth sliding action and secure retention of the tray or blister pack against unwanted motion within the container.

The container is preferably formed from a sheet material and a molded material. The sheet material may be paperboard, plastic or other planar material, preferably being somewhat stiff and suitable for printing one or both sides. The molded material may be plastic, paperboard, or other material, preferably having at least a slightly rigid structure to provide packaging strength. The molded material may for example be a thermoformed plastic, or a pressed paperboard material. It is understood that thermoforming and pressing processes may involve the application to the material of one or more of heat, pressure, and vacuum, and in the case of certain materials like paperboard, of moisture. Thus, a sheet portion of the container, such as the base or lid, may be folded from a blank cut from a substantially flat sheet or roll of material. The shell and frame portions It may also be formed by a moulding process, e.g. vacuum moulding or injection moulding. In some cases, such techniques may also be used together, e.g. a pre-form may be made by vacuum moulding or injection moulding technique and then parts of the container folded to create the base portion and/or lid portion thereof.

In the container, the lid portion and base portion each extend over a major face of the container (rather than a minor face thereof). The separation between the lid and base portions is sufficiently deep (in a direction perpendicular to their major face, in certain embodiments approximately equal to the width of a hinge portion) to house a shell to contain a blister pack. Generally, the lid and base portions comprise a substantially rectangular major face. Preferably, the depth of the container is relatively small compared to the length and/or width of the container.

Other exemplary and optional features of the invention will be apparent from the following description and from the subsidiary claims.

The invention will now be further described, merely by way of example, with reference to the accompanying drawings, in which:

FIG. 8A is a perspective view corresponding to FIG. 7 after the major parts have been joined together, in an open configuration, and with a blister pack shown partially inserted therein; and FIG. 8B is a perspective view corresponding to FIG. 7, with the finished container in a closed configuration.

FIGS. 10A and 10B are perspective views of a fifth embodiment where certain parts are made of pressed paperboard;

FIGS. 14A and 14B are perspective views of a container being used with an electronic monitoring device.

Figure 1:
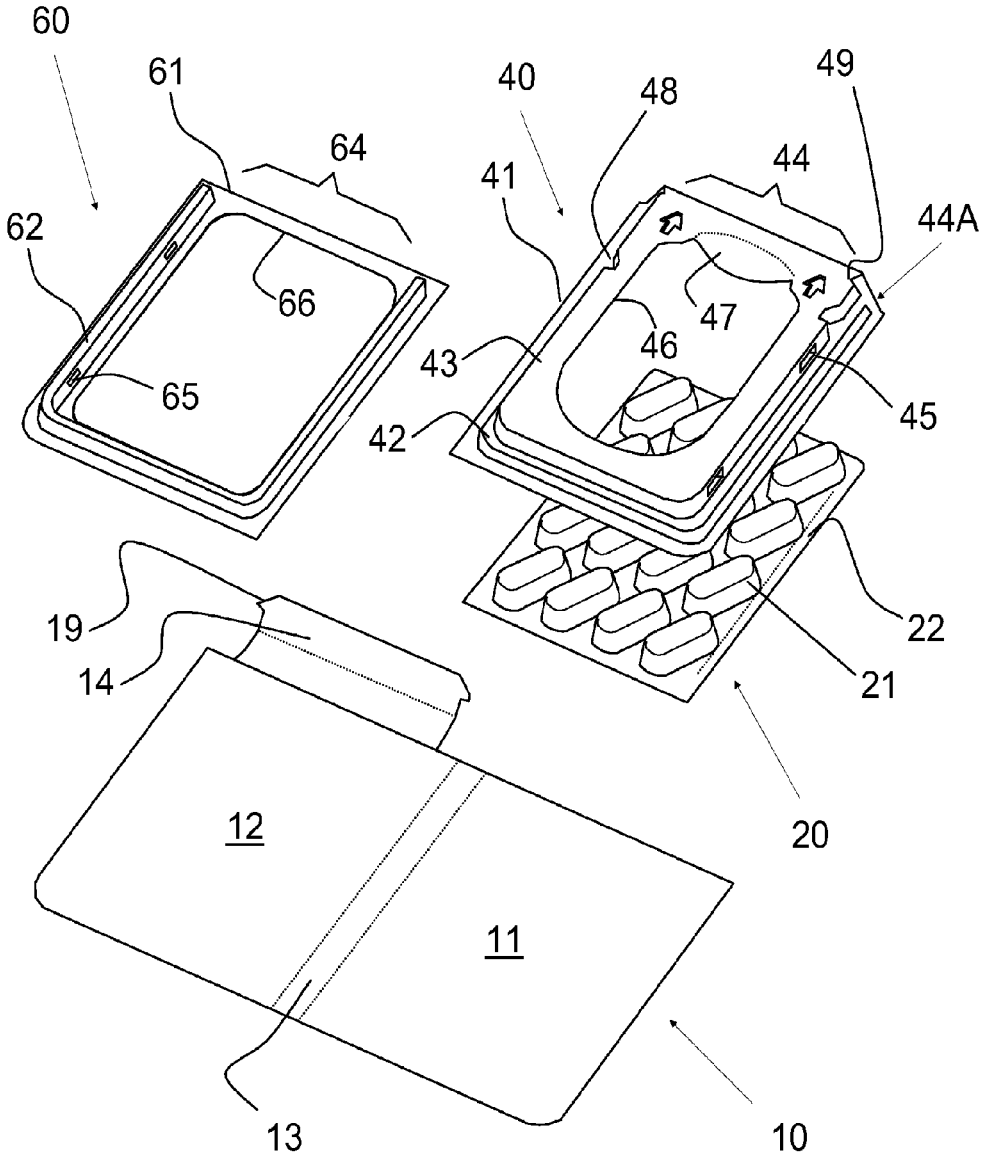
FIG. 1 is a perspective, exploded view of major parts of a first embodiment of a container according to the present invention showing the container component parts not yet joined together, and with a blister pack shown in proximity thereto.

FIG. 1 shows a first embodiment of a container comprising a cover 10, a shell 40, and a frame 60. The cover 10 may be formed from a sheet material such as paperboard, and comprises a base portion 11, a lid portion 12 and a hinge portion 13 that connects the base portion 11 to the lid portion 12. A structure similar to a book cover is thus formed, which may be printed on one or both sides. Attached to one edge of lid 12 is a closure flap 14 with a closure tooth 19.

A shell portion 40 is provided that may be a thermoformed plastic or pressed paperboard structure. The shell portion 40 may also be provided by other means such as, for example, injection molding. The shell portion 40 has a shell sealing surface 41, for example, for heat sealing or otherwise attaching to base 11. The shell portion 40 has an interior volume defined in part by a first recess 42 adjacent to base 11, and a second recess 43. The second recess 43 as shown is deeper than the first recess 42. One end of shell 40 is open as shell outlet 44. One or more raised area or shell catch 45 may be provided around the outside of the side lateral walls of the second recess 43.

The upper surface of second recess 43 has a shell cutout area 46 for access to the interior of the shell. Shell cutout area 46 may be large enough for a finger to be inserted therethrough to move contents such as blister pack 20. Slide tab 47 may be provided on an edge of the cutout area 46, from which the slide tab 47 is formed so as to ride with light pressure upon the tops of blisters 21. On the periphery of second recess 43 may be provided one or more indexing detents 48 which interfere slightly with movement of blisters 21 so as to allow blister pack 20 to be moved in shuttle fashion in and out of shell 40. One or more of shell 40, indexing detent 48, and blister 21 are formed so as to flex slightly under an applied force, such as pressure from finger inserted through shell cutout areas 46 to move the blister pack in or out of shell 40.

Shell cutout area 46 may have a different shape or size than the example shown in FIG. 1. A larger shell cutout area potentially provides more visibility for information printed on the inside of base 11, and more area upon which to push on the blister pack 20 to move it into or out of shell 40. In certain embodiments, the shell cutout area 46 may be wide enough for a fingertip or portion of a fingertip to contact one or more blisters 21 and thereby move blister pack 20 out of, or into, shell 40. Thus, the shell cutout area may have a length (in the direction of blister pack movement) at least as long as the pitch between blisters in that direction.

A relatively small shell cutout area may provide more protection of blister pack 20, and may provide more strength to the container. Preferably the upper surface of shell 40 remaining beyond shell cutout area 46 is sufficient to at least partially overlap the side rows of blisters 21. Sufficient material may be left after removing shell cutout area 46 so that least about one quarter of the side blisters is covered by the shell.

A frame portion 60 is provided that may be a thermoformed plastic or pressed paperboard structure. The frame portion 60 may also be provided by other means such as, for example, injection molding. The frame portion 60 has a frame sealing surface 61, for example, for heat sealing or otherwise attaching to lid 12. The frame portion 60 has an frame rail 62, shown in approximately "U" shape, and open at one end with frame outlet 64 facing the same direction as shell outlet 44. The frame 60 may have a frame cutout area 66, for example to allow visibility of information printed on the inside of lid 12. One or more depressed area or frame catch 65 may be provided around the inside of frame rail 62. While frame rail 62 is shown as a continuous "U" shape, which provides good strength and stability, other configurations are possible, such a discontinuous frame rail, a frame rail having two sides instead of three, etc.

The blister pack 20 has a generally planar face (on the underside in the view shown) comprising a rupturable sheet of foil and an array of blisters 21 on the opposite face (the upper face in the views shown) for housing articles, e.g. pills. Such blister packs are well known so will not be described further. The blister pack may be installed in the container at a stage during manufacture of the container or may be inserted at a later stage.

The blister pack is provided with peripheral portions 22, 23 along each side thereof and, as are typically provided for convenience and to ensure a good seal around blisters located at the edges of the blister pack. These peripheral portions 22, 23 may be used advantageously in a sliding fit within certain recesses of the container, as will be described.

During the making of shell 40, a cutting operation such as die-cutting or guillotining may be used to create the opening for shell outlet 44. To facilitate cutting of the shell material, the sides of shell 40 may be sloped as shown by slope 44A. Such a slope may for example help prevent crushing that may occur if a straight vertical wall is cut.

Figure 2A:
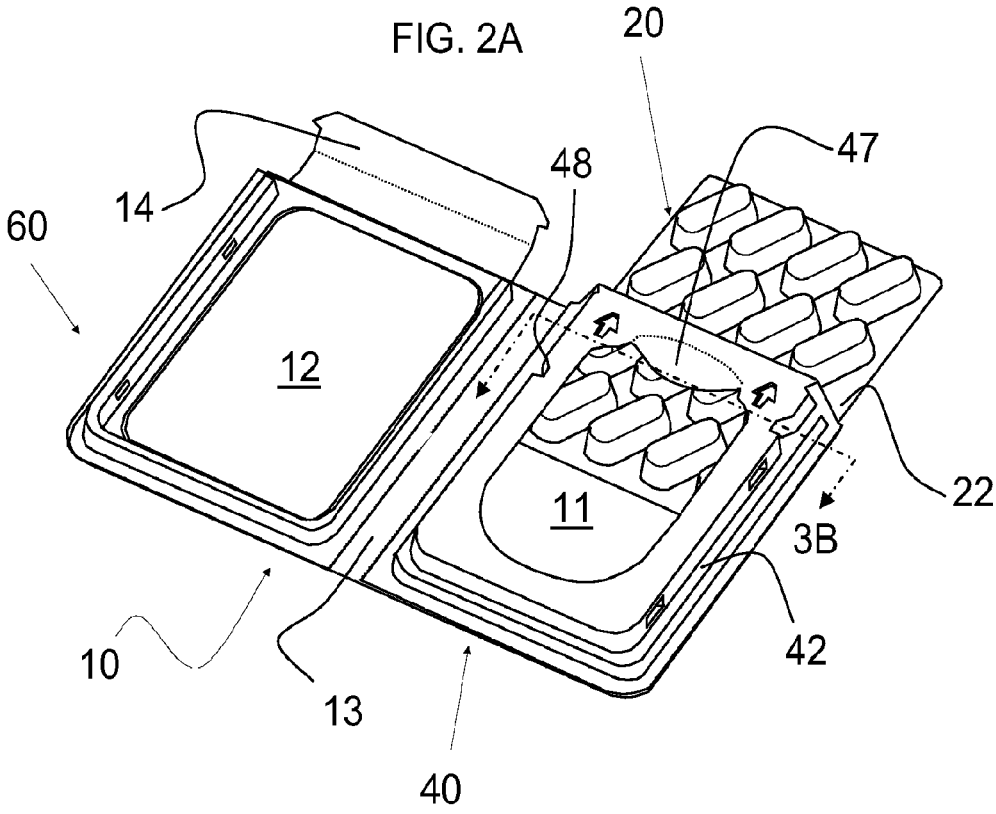
FIG. 2A is a perspective view corresponding to FIG. 1 after the major parts have been joined together, in an open configuration, and with a blister pack shown partially inserted therein.

FIG. 2A shows an assembled container where shell 40 has been attached to base 11, for example by heat sealing, and frame 60 has been attached to lid 12, for example by heat sealing. Portions of the interior surfaces of base 11 and lid 12 are visible through the shell cutout area 46 and frame cutout area 66, respectively. A blister pack 20 may be inserted into shell 40 through shell outlet 44.

Figure 2B:
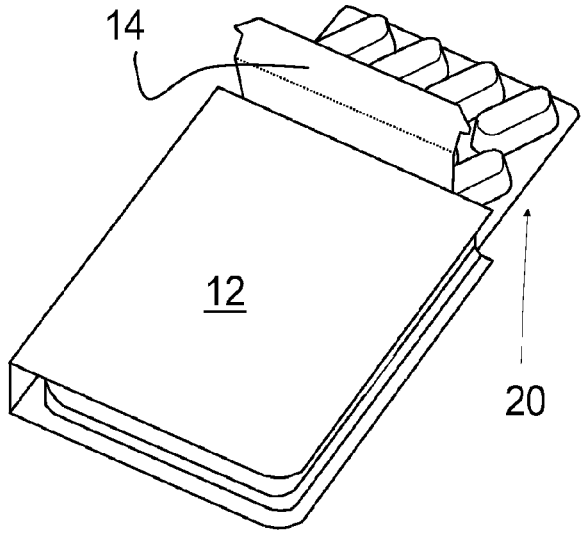
FIG. 2B is a perspective view corresponding to FIG. 1, with the finished container in a closed configuration.

The lid 12 and base 11 are connected by hinge portion 13, through which the lid and base may fold or hinge to a closed configuration shown in FIG. 2B. In the closed configuration, the shell catch 45 and frame catch 65 may engage in a snap fit to help hold the container closed. Once the blister pack 20 has been inserted into shell 40, and the lid 12 with frame 60 closed upon base 11 and shell 40, the closure flap 14 may be foldably inserted into the container to close the container. To help hold the closure flap in the closed position, closure tooth 19 may engage closure notch 49 located in the shell 40.

During manufacture of the container shown in FIGS. 1 and 2, there are several methods by which the blister pack 20 can be inserted. Having formed the structure, blister pack 20 may be inserted into the open configuration shown in FIG. 2A. Alternately, blister pack 20 may be inserted into the closed configuration shown in FIG. 2B, before the closure flap 14 is folded into place. Another option is to form or place the shell 40 in an inverted position with its first recess 42 and second recess 43 facing upward, drop or place the blister pack into the shell 40, then attach base 11 onto the shell. Thus, this embodiment of the container is quite flexible with regard to filling processes.

Shell 40 and frame 60 may be separately formed, and separately joined onto base 11 and lid 12 respectively. Alternately, shell 40 and frame 60 may be simultaneously attached to the base 11 and lid 12.

Since the first recess 42 is wider and shallower than second recess 43, the first recess 42 may be used to provide a guide slot or guide slots for the blister pack peripheral edge 22. This helps stabilize or guide the sliding motion of blister pack 20, and helps retain blister pack 20 against excessive movement within the container. The depth of first recess 42 may therefore be designed to allow fairly close fit with the blister pack peripheral edge 22.

Since the second recess 43 is narrower and deeper than first recess 42, the second recess 43 may be used to provide good fit for the blisters 21. This also helps stabilize or guide the sliding motion of blister pack 20, and helps retain blister pack 20 against excessive movement within the container. The depth of second recess 43 may therefore be designed to allow fairly close fit with the upper surfaces of the blisters 21, while the width and depth of second recess 43 may be designed to allow fairly close fit with the lateral surfaces of the outer rows of blisters 21. Furthermore slide tab 47 may be designed to provide a light pressure upon the tops of blisters 21.

Figure 2C:
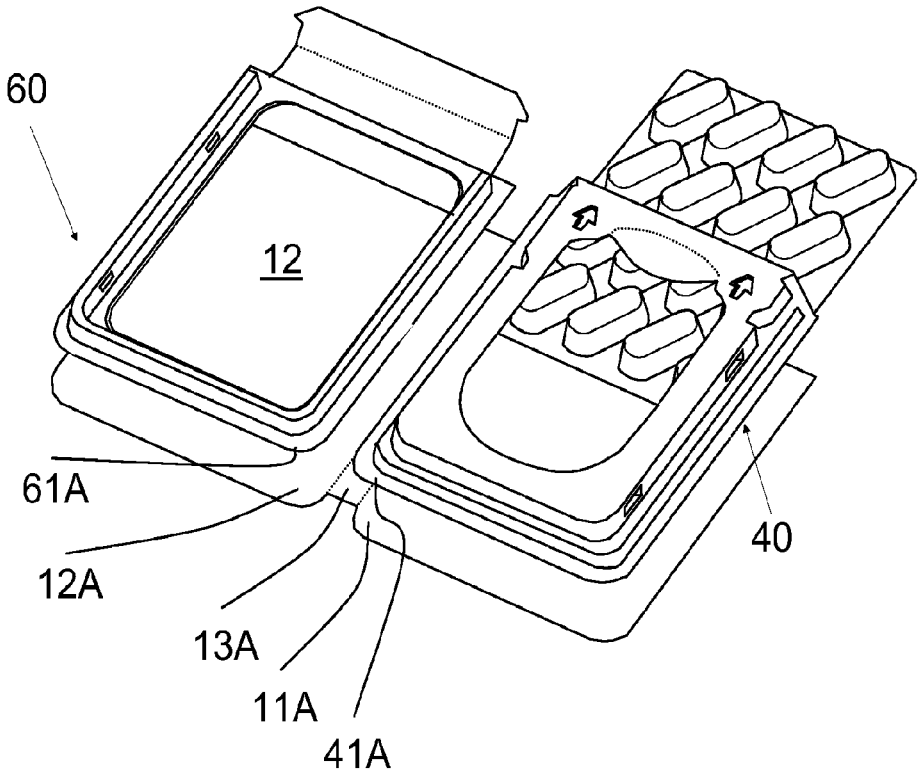
FIG. 2C is a perspective view of a variation corresponding to FIG. 1, with the major parts in proximity to one another in an open configuration.
Figure 2D:
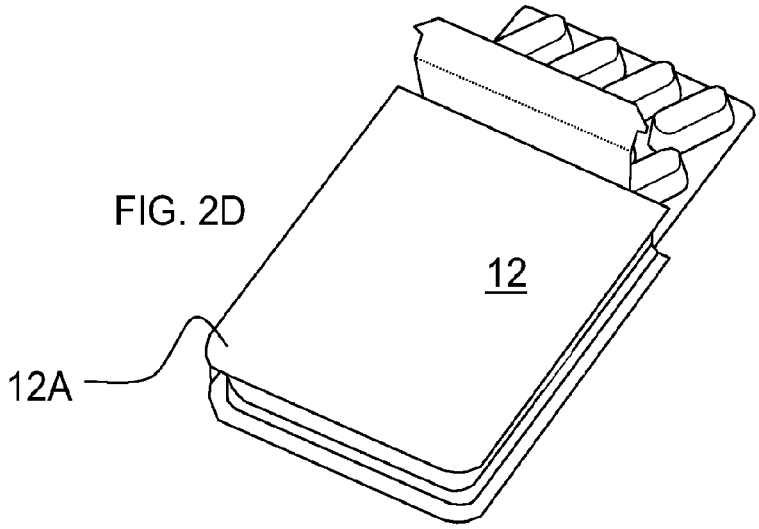
FIG. 2D is a perspective view of the variation of FIG. 2C, with the finished container in a closed configuration.

FIG. 2C shows a variation wherein a corner of the container is modified to form a rounded profile. In FIG. 2C, the lower part of spine 13A is slightly shorter, and the proximate corners 11A, 12A of the base 11 and lid 12, respectively, are rounded. Likewise the proximate corners 41A, 61A of the shell sealing edge 41 and frame sealing edge 61, respectively, are rounded. As a result, when the container is closed as shown in FIG. 2D, a rounded corner results as denoted by corner 12A.

Figure 3A:
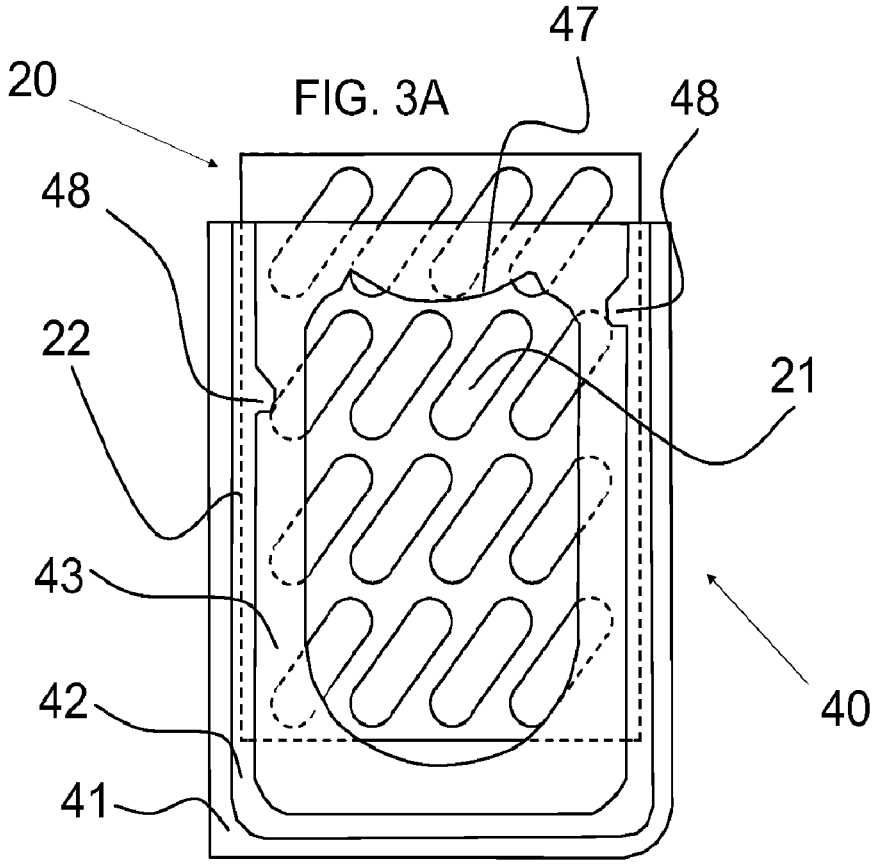
FIG. 3A is a top, partial cutaway view of a portion of the container of FIG. 2A.

FIG. 3A shows a top view of a blister pack 20 partially inserted into shell 40. Dashed lines show portions of the blister pack 20 and blisters 21 that would otherwise be hidden by shell 40. The peripheral edge 22 of blister pack 20 is shown fitting closely within first recess 42. The outermost surfaces of blisters 21 likewise fit closely within second recess 43. Furthermore, there may be an interference fit between indexing detents 48 and the extreme points on blisters 21. The indexing detents 48 or the blisters 21 may flex slightly to allow the blister pack 20 to slide back and forth in shell 40.

Figure 3B:
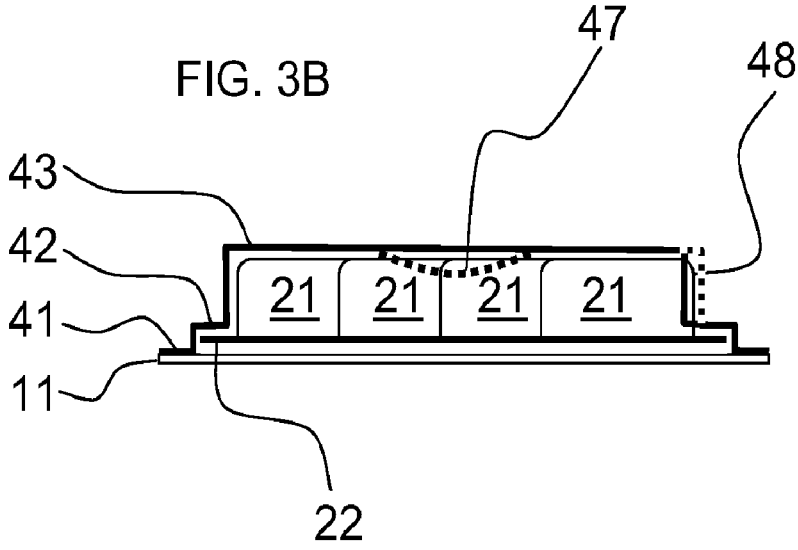
FIG. 3B is an end cross section view of a portion of the container of FIG. 2A.

FIG. 3B shows an end view cross section of shell 40 and blister pack 20, as sectioned through the portion denoted as arrow 3B on FIG. 2A. The base 11 is shown attached to shell sealing surface 41. The peripheral edge 22 of the blister pack is shown fitting closely within first recess 42. The outermost lateral and top surfaces of blisters 21 likewise fit closely within second recess 43, giving a close fit both side-to-side and up-and-down. Furthermore, there may be an interference fit between indexing detents 48 and the extreme points on blisters 21. There may also be an interference fit between slide tab 47 and the top surfaces of blisters 21.

The blisters 21 shown here have an oblong shape, are arranged in an approximately rectangular array, and are positioned at an angle relative to the edges of blister pack 20. However, the blisters could have other shapes, be placed in other arrangements, and (if non-circular) positioned at other angles relative to the edges of the blister pack. The container, and particularly shell 40, may be designed to accommodate a variety of blister types.

Figure 4:
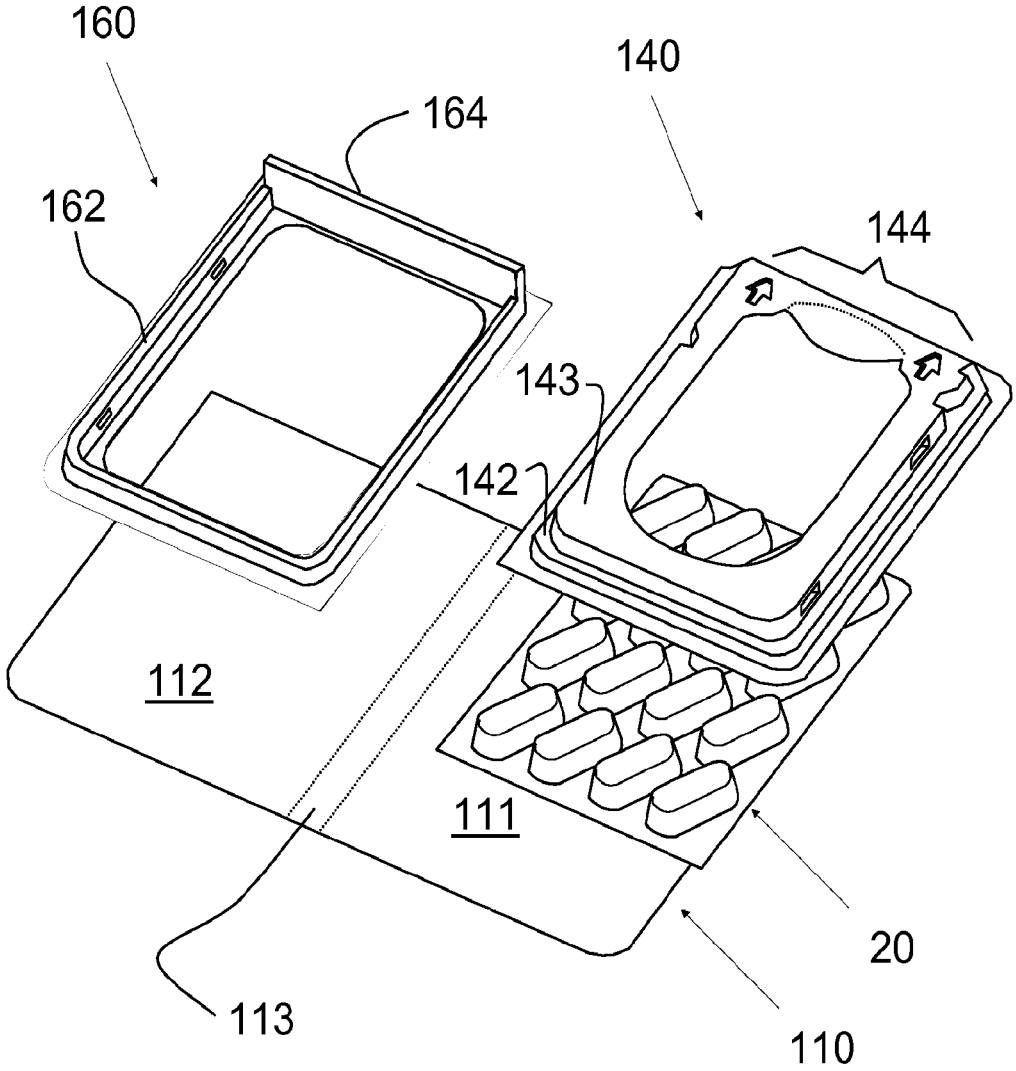
FIG. 4 is a perspective, exploded view of major parts of a second embodiment of a container showing the container component parts not yet joined together, and with a blister pack shown in proximity thereto.

FIG. 4 shows a second embodiment of a container comprising a cover 110, a shell 140, and a frame 160. Certain features of this container are similar to the container shown in FIGS. 1 and 2, whose description need not be repeated.

Frame portion 160 is provided has an frame rail 162, shown in approximately "U" shape, and closed at one end with closure gate 164 facing the same direction as shell outlet 144. To provide clearance for the closure gate 164, the opening end of shell 140 (e.g. at shell outlet 144) may not extend as far out as the shell 40.

Figure 5A:
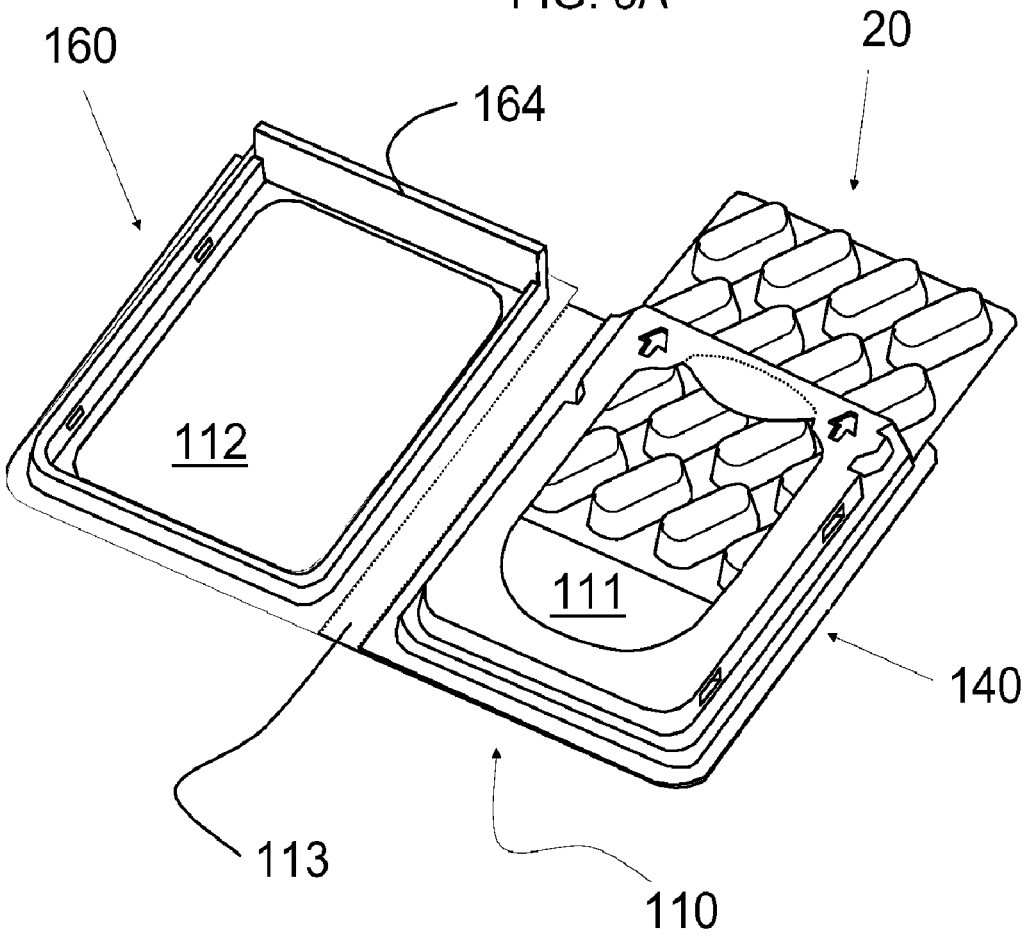
FIG. 5A is a perspective view corresponding to FIG. 4 after the major parts have been joined together, in an open configuration, and with a blister pack shown partially inserted therein.

FIG. 5A shows an assembled container where shell 140 has been attached to base 111, for example by heat sealing, and frame 160 has been attached to lid 112, for example by heat sealing. Portions of the interior surfaces of base 111 and lid 112 are again visible through the shell cutout area and base cutout area, respectively. A blister pack 20 may be inserted into shell 140 through shell outlet 144.

Figure 5B:
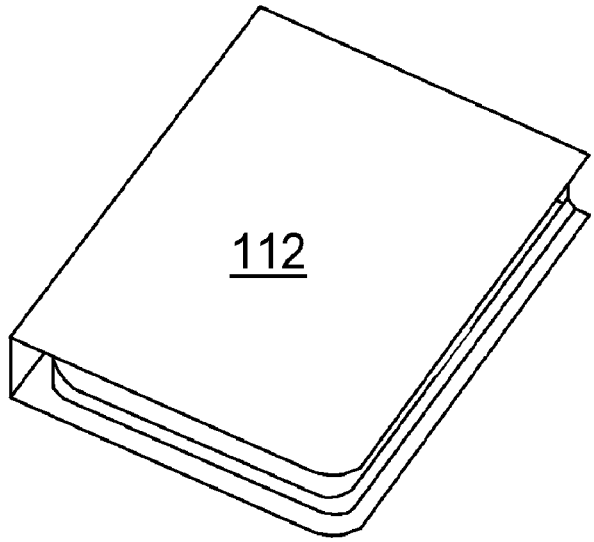
FIG. 5B is a perspective view corresponding to FIG. 4, with the finished container in a closed configuration.

The lid 112 and base 111 are connected by hinge portion 113, through which the lid and base may fold or hinge to a closed configuration shown in FIG. 5B. Once the blister pack 20 has been inserted into shell 140, and the lid 112 with frame 160 closed upon base 111 and shell 140, the closure gate 164 closes the shell outlet 144.

During manufacture of the container shown in FIGS. 4 and 5, there are several methods by which the blister pack 20 can be inserted. Having formed the structure, blister pack 20 may be inserted into the open configuration shown in FIG. 5A. Another option is to form or place the shell 140 in an inverted position with its first recess 142 and second recess 143 facing upward, drop or place the blister pack into the shell 140, then attach base 111 onto the shell. Thus, this embodiment of the container is quite flexible with regard to filling processes.

Figure 6A:
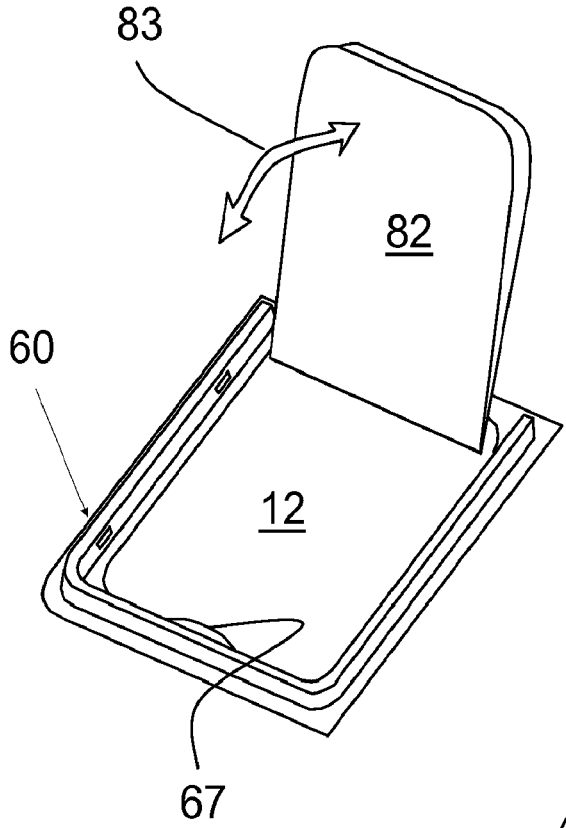
FIGS. 6A and 6B are perspective views of the inside of the lid of the container of FIG. 2A, showing exemplary methods of providing additional area for printed materials.

FIG. 6A shows an embodiment where one or more optional information pages 82 may be provided. As seen before, frame portion 60 may have a frame cutout area 66 through which the inside of lid 12 may be visible. This area of the lid can be printed with information. To provide more space for information, information pages 82 may be hingedly attached to the lid 12 or the periphery of frame 60, and may be moved back and forth by motion 83 to provide access to printed information. A page retainer 67 may be provided, for example a tab on the frame 60. The information pages 82 are shown as attached to the upper area of lid 12, but the attachment location may be chosen as desired.

Figure 6B:
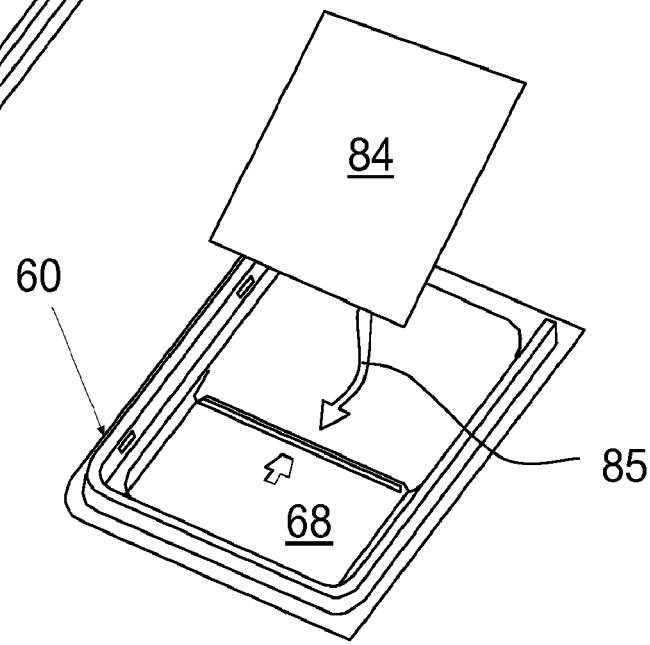

FIG. 6B shows another embodiment where an leaflet 84 may be provided. As seen before, frame portion 60 may have a frame cutout area 66 through which the inside of lid 12 may be visible. A portion of this otherwise open area may be used instead as a frame pocket 68 for receiving leaflet 84. which may be inserted therein by motion 85. The frame pocket 68 is shown as located at the lower area of frame 60, but the location may be chosen as desired.

Figure 7:
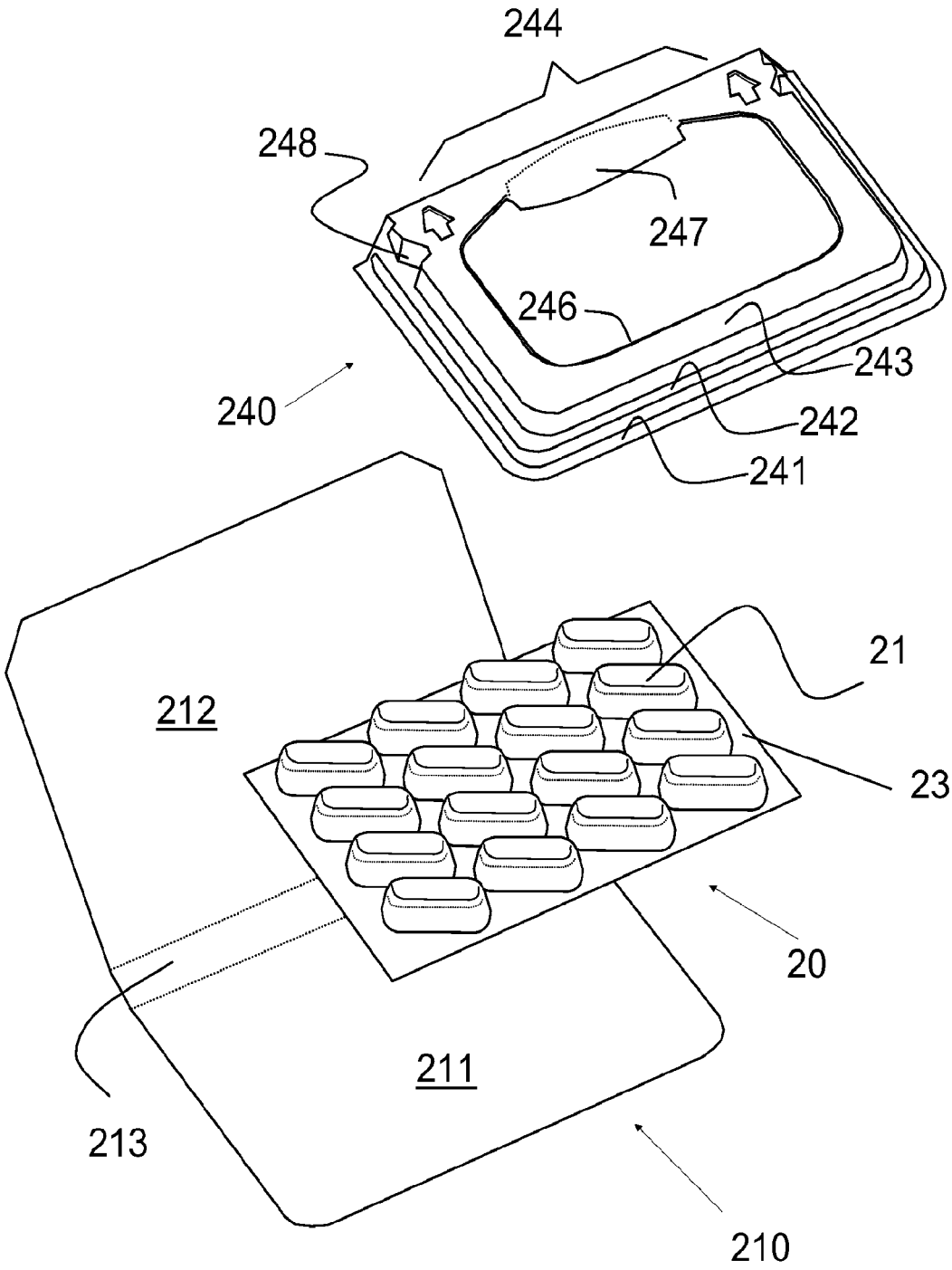
FIG. 7 is a perspective, exploded view of major parts of a third embodiment of a container showing the container component parts not yet joined together, and with a blister pack shown in proximity thereto.

FIG. 7 shows a third embodiment of a container comprising a cover 210 and a shell 240. Certain features of this container are similar to features shown in FIGS. 1 through 5, and need not be described again. The cover 210 may be formed from a sheet material such as paperboard, and comprises a base portion 211, a lid portion 212 and a hinge portion 213 that connects the base portion 211 to the lid portion 212. A structure similar to a book cover is thus formed, which may be printed on one or both sides. The lid portion 212 may be provided with one or more additional flaps hingedly attached thereto (not shown) that in the closed configuration may be folded together forming a lid with several plies of material. The one or more additional flaps may provide additional space for printed information.

A shell portion 240 is provided that may be a thermoformed plastic or pressed paperboard structure. The shell portion 240 may also be provided by other means such as, for example, injection molding. The shell portion 240 has a shell sealing surface 241, for example, for heat sealing or otherwise attaching to base 211. The shell portion 240 has an interior volume defined in part by a first recess 242 adjacent to base 211, and a second recess 243. The second recess 243 as shown is deeper than the first recess 242. One end of shell 240 is open as shell outlet 244. Preferably shell outlet 244 is proximate to hinge portion 213.

The upper surface of second recess 243 has a shell cutout area 246 for access to the interior of the shell. Shell cutout area 246 may be large enough for a finger to be inserted therethrough to move contents such as blister pack 20. Slide tab 247 may be provided on an edge of the cutout area 246, from which the slide tab 247 is formed so as to ride with light pressure upon the tops of blisters 21. On the periphery of second recess 243 may be provided one or more indexing detents 248 which interfere slightly with movement of blisters 21 so as to allow blister pack 20 to be moved in shuttle fashion in and out of shell 240. One or more of shell 240, indexing detent 248, and blister 21 are formed so as to flex slightly under an applied force, such as pressure from finger inserted through shell cutout areas 246 to move the blister pack in or out of shell 240.

FIG. 8A shows an assembled container where shell 240 has been attached to base 211, for example by heat sealing. A portion of the interior surface of base 211 is visible through the shell cutout area 246. A blister pack 20 may be inserted into shell 240 through shell outlet 244.

The lid 212 and base 211 are connected by hinge portion 213, through which the lid and base may fold or hinge to a closed configuration shown in FIG. 8B. Once the blister pack 20 has been inserted into shell 240, and the lid 212 closed upon base 211 and shell 240, hinge portion 213 acts as a closure over shell outlet 244. The lid portion 212 may be provided with one or more additional flaps hingedly attached thereto (not shown) that in the closed configuration may be folded together forming a lid with several plies of material. The one or more additional flaps may provide additional space for printed information.

During manufacture of the container shown in FIGS. 7 and 8, there are several methods by which the blister pack 20 can be inserted. Having formed the structure, blister pack 20 may be inserted into the open configuration shown in FIG. 8A. Another option is to form or place the shell 240 in an inverted position with its first recess 242 and second recess 243 facing upward, drop or place the blister pack into the shell 240, then attach base 211 onto the shell. Thus, this embodiment of the container is quite flexible with regard to filling processes.

Since the first recess 242 is wider and shallower than second recess 243, the first recess 242 may be used to provide a guide slot or guide slots for the blister pack peripheral edge 23. This helps stabilize or guide the sliding motion of blister pack 20, and helps retain blister pack 20 against excessive movement within the container. The depth of first recess 242 may therefore be designed to allow fairly close fit with the blister pack peripheral edge 22.

Since the second recess 243 is narrower and deeper than first recess 242, the second recess 243 may be used to provide good fit for the blisters 21. This also helps stabilize or guide the sliding motion of blister pack 20, and helps retain blister pack 20 against excessive movement within the container. The depth of second recess 243 may therefore be designed to allow fairly close fit with the upper surfaces of the blisters 21, while the width and depth of second recess 243 may be designed to allow fairly close fit with the lateral surfaces of the outer rows of blisters 21. Furthermore slide tab 247 may be designed to provide a light pressure upon the tops of blisters 21.

Figure 9A:
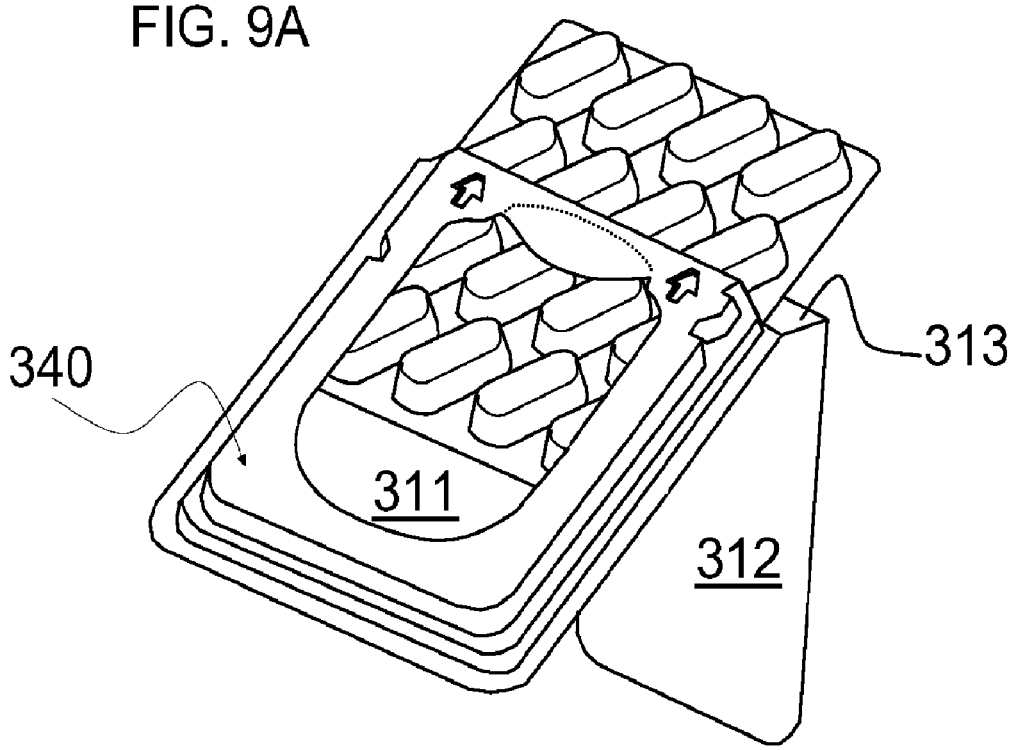
FIG. 9A is a perspective view of a fourth embodiment after the major parts have been joined together, in an open configuration, and with a blister pack shown partially inserted therein.

FIG. 9A shows a fourth embodiment of a container comprising a cover and a shell. Certain features of this container are similar to features shown in previous Figures, and need not be described again. This embodiment is similar to that in FIGS. 7 and 8, but the blister access is through a narrow edge of the container. The cover may be formed from a sheet material such as paperboard, and comprises a base portion 311, a lid portion 312 and a hinge portion 313 that connects the base portion 311 to the lid portion 312. A structure similar to a book cover or notebook cover is thus formed, which may be printed on one or both sides. The lid portion 312 may be provided with one or more additional flaps hingedly attached thereto (not shown) that in the closed configuration may be folded together forming a lid with several plies of material. The one or more additional flaps may provide additional space for printed information.

Figure 9B:
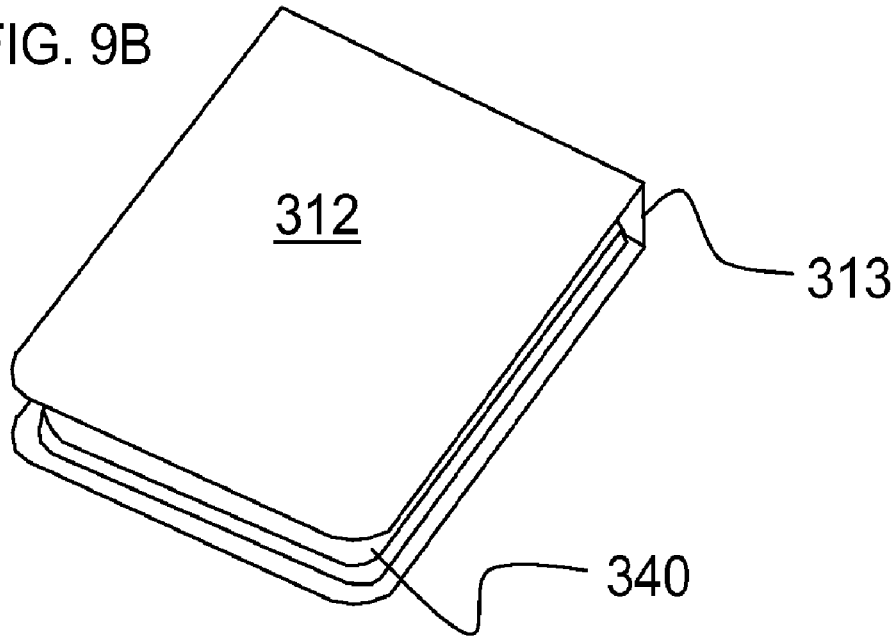
FIG. 9B is a perspective view corresponding to FIG. 9A, with the finished container in a closed configuration.

A shell portion 340 is provided that may be a thermoformed plastic or pressed paperboard structure. The shell portion 340 may also be provided by other means such as, for example, injection molding and attached to the base as described previously. FIG. 9A shows the assembled container with blister pack 20 inserted partway into the container. FIG. 9B shows the closed container.

During manufacture of the container shown in FIG. 9, there are several methods by which the blister pack 20 can be inserted. Having formed the structure, blister pack 20 may be inserted into the open configuration shown in FIG. 9A. Another option is to form or place the shell 340 in an inverted position, drop or place the blister pack into the shell 340, then attach base 311 onto the shell. Thus, this embodiment of the container is quite flexible with regard to filling processes.

FIG. 10A shows a shell 440 made from a pressed material such as pressed paperboard, for containing a blister pack 20. Properties of pressed paperboard may differ from thermoformed plastic, so certain features of shell 440 may differ from features of previously described shells. For example, the perimeter of shell cutout area 446 may have a formed contour to add strength. An indented region 447 may be used instead of the slide tab shown for thermoformed shells. Indexing detent 448 may have a different shape, for example a more gradual contour, than for thermoformed shells. Similar to shells already described, a flat shell sealing surface 441 may be present around the perimeter of shell 440. Instead of a having two stepped recesses, pressed paperboard shell 440 made have a sloped wall 442.

FIG. 10A is an idealized drawing of shell 440. FIG. 10B shows a somewhat more realistic drawing of the pressed paperboard shell after attachment to base 411 (with its attached hinge 413 and lid 412). Certain features of a realistic shell may be slightly different than the idealized shape. For example, corners of the shell, as represented by corner 441A, may undergo a controlled creasing or puckering during the press forming operation. The shape of indexing detent 448A may differ slightly from the idealized shape, and may even contain some torn or open areas. These differences may occur because paperboard is less "plastic" than an actual plastic material.

Figure 11:
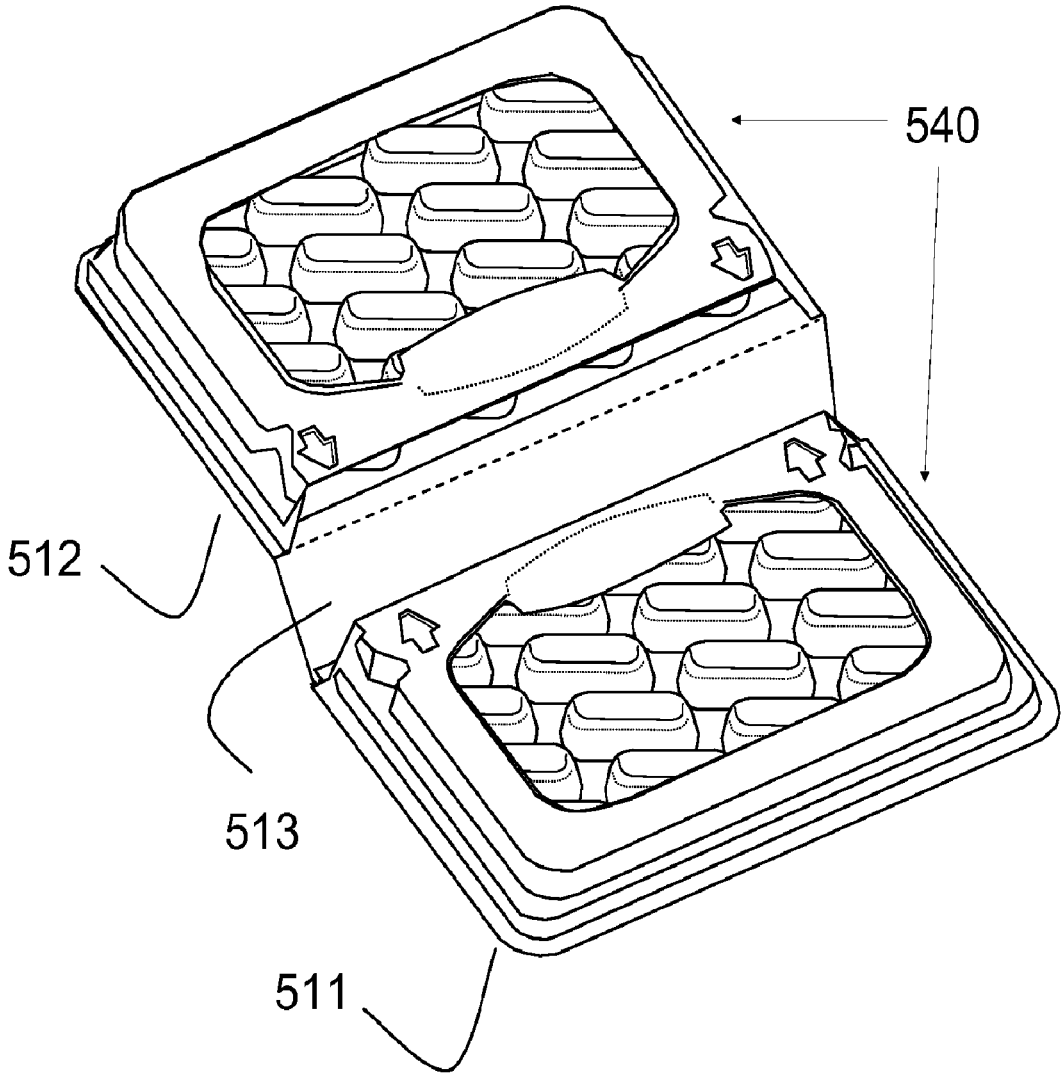
FIG. 11 is a perspective view of a sixth embodiment, capable of holding two blister packs.

FIG. 11 shows an assembled container that is similar in some respects to the container of FIG. 8A, but the container of FIG. 11 comprises two shells 540, one attached to base 511, and the other attached to lid 512. Again the base and lid are connected by hinge 513 that may be made wide enough to accommodate the added thickness of the second shell.

Figure 12A:
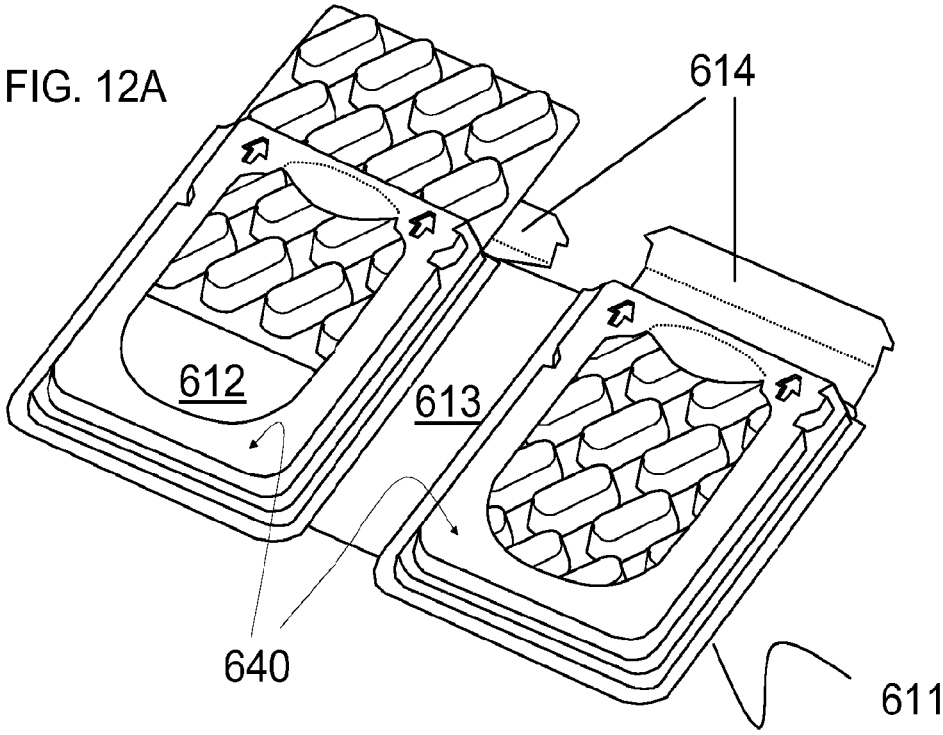
FIG. 12A is a perspective view of a seventh embodiment, capable of holding two blister packs in a different orientation.

FIG. 12A shows an assembled contained that is similar in some respects to the container of FIG. 2C, but the container of FIG. 12A comprises two shells 640, one attached to base 611, and the other attached to lid 612. The base and lid are interconnected by hinge 613 that may be made wide enough to accommodate the added thickness of the second shell. The open ends of each shell may each be closed by a closure flap 614. Alternately, one closure flap (not shown) may be provided which is wide enough to close both shells when the container is in the closed configuration.

Figure 12B:
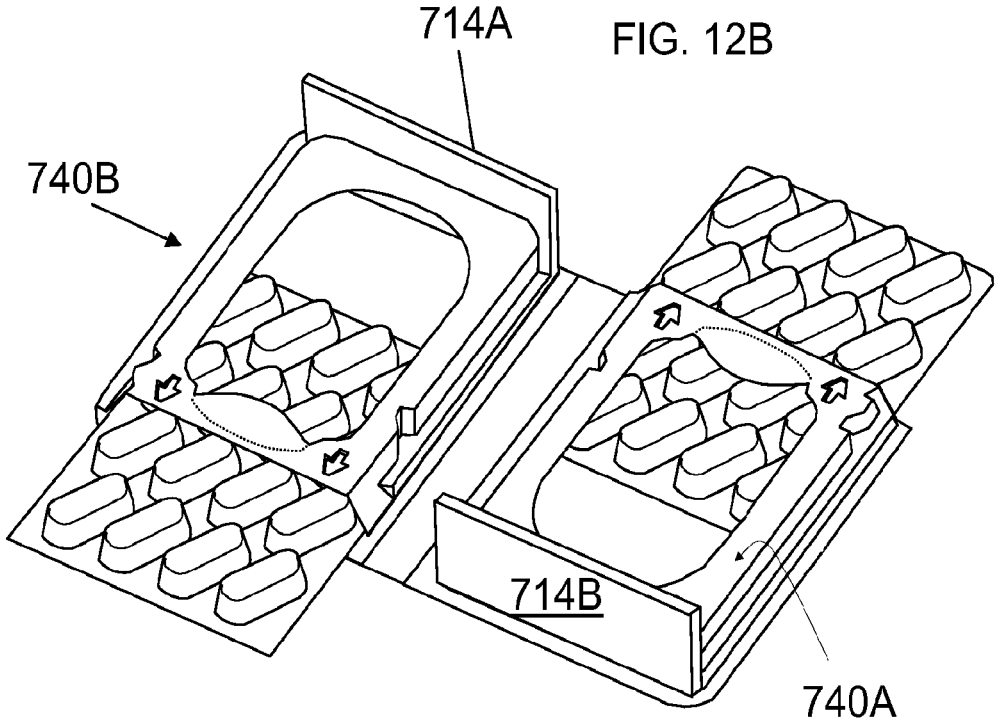
FIG. 12B is a perspective view of an eighth embodiment, capable of holding two blister packs in a different configuration.

For the container shown in FIG. 12A, the blister packs slide out from the same end. However, the container may also be designed for the blister packs to slide out from one end of the first shell and the other end of the second shell. In such a case, a closure flap for each shell could be provided in appropriate proximity to that shell's opening. In the case of a container where the blister packs slide out from opposite ends, closure of the shell could also be achieved as shown in FIG. 12B by a gate 614. With the container housing two blister packs, the gate 714A for the first shell 740A may be provided on the closed end of the second shell 740B; likewise the gate 714B for the second shell 740B may be provided on the closed end of the first shell 740A. When the container is in the open configuration as shown in FIG. 12B, the gates 714A, 714B do not close the shells; when the container is in the closed configuration (not shown), the gates close the otherwise open end of each shell.

Figure 13:
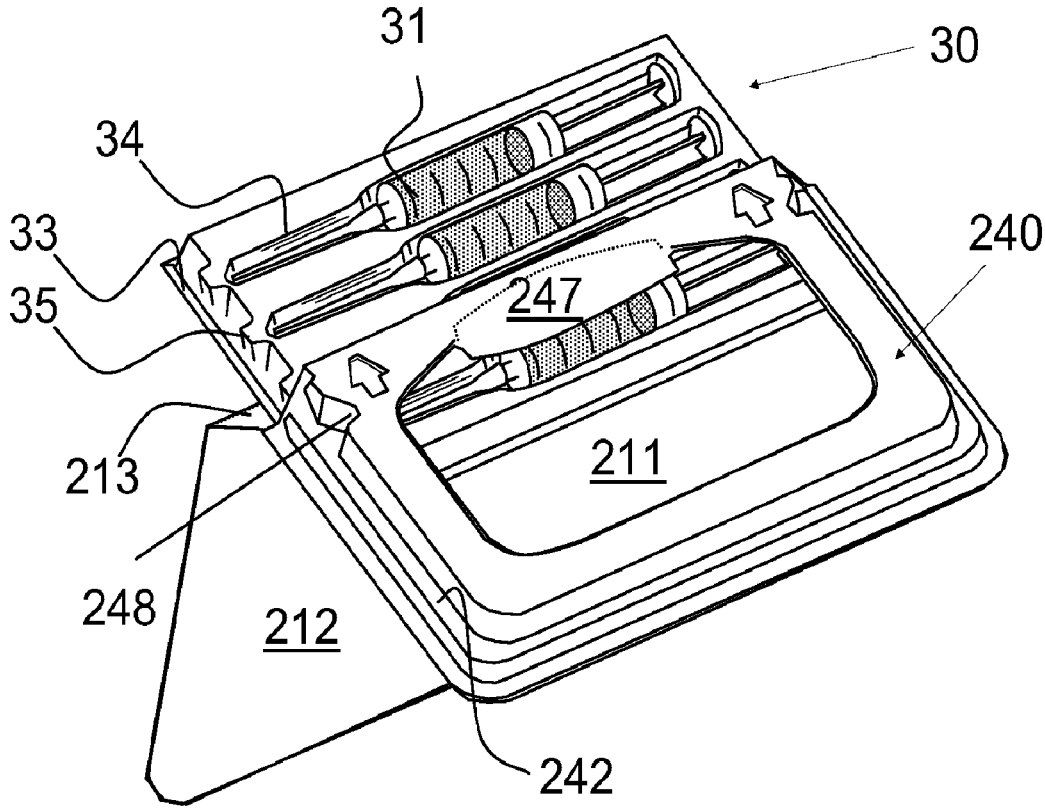
FIG. 13 is a perspective view of an embodiment similar to that of FIG. 8A, in an open configuration, and with a tray shown partially inserted therein.

FIG. 13 is similar to FIG. 8A, in that it shows an assembled container where shell 240 has been attached to base 211, for example by heat sealing. A portions of the interior surface of base 211 is visible through the shell cutout area 246. A tray such as receptacle 30 may be inserted into shell 240. In this example, receptacle 30 is a thermoformed structure holding syringes 31 in recesses 34 formed in the tray. Receptacle 30 may have an edge 33 to be received within first recess 242 of tray 240. Depending on the design of receptacle 30, certain parts of syringes 31 or their respective recesses 34, may interact with indexing detents 248 to provide one or more yieldable stops as the tray 30 slides into and out of shell 240, or indexing teeth 35 may be molded in receptacle tray 30 to interact with indexing detents 248 to provide yieldable stops.

Blister pack 20 and receptacle 30 are examples of trays that may be used with various embodiments of the containers disclosed here. A tray may also take the form of a formed, molded, pressed, folded, or otherwise structure, suitable for slidable motion into and out of the shell. Thus the tray may also be created wholly or in part by folding or cutting a sheet material such as paperboard, for example to create receptacles to hold syringes. Instead of the tray having formed recesses 34, it may be made with friction gripping posts or other attachment devices to partly encircle or grasp portions of the syringes. Items other than syringes may be held by the tray.

FIG. 14A shows how a container, such as the container shown previously in FIG. 9A, may be provided with a tear-away line 815 such as a perforated, scored, or partially cut line by which the hinge 813 and lid 812 may be torn off, leaving the shell 840 and its attached base 811. (Each of the containers previously shown may likewise be designed with the shell/base able to be removed from the hinge.)

FIG. 14B shows how shell 840 along with attached base 811 may be inserted into a device such as compliance monitor 900. Various modes of insertion and attachment may be contemplated. In FIG. 14B, the sealing edge 841 may be slid into an appropriately sized groove 910 in compliance monitor 900. Compliance monitor 900 may include electronic features such as memory, logic, a timer, communications with external devices, visible or audible alerts, and features such as a display 901, input buttons 902, etc. The shell thus provides a convenient "cartridge" with which to "reload" compliance monitor 900. The shell 840 may be provided with suitable features to securely engage corresponding features of compliance monitor 800. For example, sealing edge 841 may comprise notches or cutouts (not shown) to engage protrusions or pins inside groove 910.

Certain parts of the container, for example the shell and frame portions, may be formed by processing such as thermoforming, vacuum forming, pressure forming, etc as is known to those skilled in the art. Certain parts may be formed by injection molding. In certain embodiments, the molded parts of the container may be made of materials chosen for heat sealing to the base and lid portions of the container, which may be coated with materials suitable for heat sealing. Alternately, other means such as adhesives may be used for attaching the molded parts to the base and lid.

Certain embodiments of the shell as shown herein use a "stepped" structure (e.g. formed in part by a first recess and a second recess), a structure that may be readily formed, for example, by thermoforming of plastic. However, alternative structures, having different numbers of steps, or having sloped sides with or without steps, are also within the scope of the disclosure. A pressed paperboard shell, for example, may have sufficient strength and be more readily formed with sloping sides rather than stepped sides.

Being able to load a tray or blister pack into the container through an open end of the container as described above is a significant advantage as such an arrangement is compatible with existing automatic filling lines such as those used for a wide range of products housed in cartons.

By forming only the shell (and optionally, a frame) of the container of plastic so that the major faces thereof are provided by the outer cover, the amount of plastic material used can be minimised. The outer cover can be securely bonded to the framework so that the security of the container is not compromised. Such an outer cover may also have information or graphics provided thereon and both faces thereof may be visible.

Each of the embodiments described above has indexing means for locating a tray or blister pack in a container and is adapted to enable sliding of the tray or blister pack within the container. The embodiments illustrate several mechanisms for achieving this, while (in the case of blister packs for example) using blister packs not requiring any special features other than the blisters themselves.

The embodiments of the containers described here are all designed to facilitate single-handed operation. The user may for example, using one hand, open the container, slide a blister card at least partly out of the shell, and press a blister to open the blister and dispense its contents.

Graphics may be provided on the external surfaces of the container, for example the external surfaces of base 11 and lid 12. Graphics may also be provided on the internal surface of the lid 12, which are visible through the frame cutout area 66 (or, for lid 212, visible since there is no frame). Graphics may also be provided on the internal surface of base 11, which are gradually revealed as the blister pack is slid out. Typically, such graphics would indicate time intervals appropriate to the medication housed in the tray or blister pack, e.g. the days of the week and/or the time of day (morning, afternoon, evening, night).

As described above, in the first embodiment even it its "closed" configuration (with the closure flap 14 open) provides an aperture through which a tray or blister pack (and, optionally, compliance literature) can be inserted into the container. The ability to load a tray or blister pack into a container in this manner provides significant advantages, as the container can then be filled in a conventional filling line, e.g. as used to load trays or blister packs into conventional cardboard cartons or plastic sleeves.

Thus, it will be appreciated that, in the preferred embodiments, the tray or blister pack can be both slid into the container and slid out of the container as articles are dispensed.

Each of the embodiments described is also advantageous in that they can house a standard blister pack which requires no modification.

The embodiments described above provide a wide variety of features. Many of these features can be inter-changed between embodiments. Further embodiments are thus envisaged which use a selection of the features from those described above. The invention thus extends to cover containers having other combinations of the features described.

The invention claimed is:

1. A container for housing a tray or blister pack having at least one blister, the container comprising a base portion, a lid portion, and a hinge portion connecting the base portion to the lid portion and about which the lid portion and/or base portion are movable between an open configuration and a closed configuration, the base portion having a shell attached thereto for receiving the tray or blister pack, the shell having an open end and being adapted to enable sliding movement of the tray or blister pack relative thereto in a direction substantially parallel to said base portion between a storage position and one or more dispensing positions, the shell having at least one detent disposed inside the shell such that the at least one detent is pressed on the at least one blister of the tray or blister pack during the sliding movement of the tray or blister pack so as to interfere slightly with the sliding movement while enabling the sliding movement, in which the shell has a top wall opposed to the base portion and a pair of side walls connecting between the top wall and the base portion, each of the side walls extending substantially in the direction of the sliding movement, the at least one detent being provided on at least one of the side walls.

2. A container as claimed in claim 1, wherein said base portion, hinge portion, and lid portion are formed from a single substantially flat folded sheet of paperboard and the shell is made of thermo-formed plastic.

3. A container for housing a tray or blister pack having at least one blister, the container comprising a base portion, a lid portion, and a hinge portion connecting the base portion to the lid portion and about which the lid portion and/or base portion are movable between an open configuration and a closed configuration, the base portion having a shell attached thereto for receiving the tray or blister pack, the shell having an open end and being adapted to enable sliding movement of the tray or blister pack relative thereto in a direction substantially parallel to said base portion between a storage position and one or more dispensing positions, the shell having at least one detent disposed inside the shell such that the at least one detent is pressed on the at least one blister of the tray or blister pack during the sliding movement of the tray or blister pack so as to interfere slightly with the sliding movement while enabling the sliding movement, in which said shell has a closed end opposite the open end thereof and comprises an opening for a finger or object to be inserted therethrough to move said tray or blister pack at least partly out of or into said shell, the opening extending from a first end edge of the opening proximate the closed end of the shell to a second opposed end edge of the opening proximate the open end of the shell, the at least one detent being a tab connected to the second end edge of the opening, in which the direction of sliding is substantially perpendicular to the second end edge to which the tab is connected.

4. A container as claimed in claim 3, further comprising a closure that closes the open end of the shell, wherein the closure is selected from one of the group consisting of at least one of a gate, a tab connected to the lid or base, or the hinge portion of the container.

5. A container as claimed in claim 3, in which said shell comprises a first recess to receive an edge of said tray or blister pack and a second, deeper recess to receive items or blisters located on said tray or blister pack.

6. A container as claimed in claim 5, wherein said first recess is sized for a close fit of at least one of the thickness, width, and length of a planar portion of said tray or blister pack.

7. A container as claimed in claim 5, wherein the tray or blister pack comprises a plurality of items or blisters and said second recess is sized for a close fit of at least one of the height, thickness, and width of the plurality of items or blisters.

8. A container as claimed in claim 3, wherein said tab provides a yieldable interference fit with the at least one blister on said tray or blister card.

9. A container as claimed in claim 3, further comprising a frame portion attached to the inside of said lid, wherein said frame portion comprises one or more of features selected from the group consisting of a closure gate and fastening means to hold the frame and shell together in the closed configuration.

10. A container as claimed in claim 3, wherein said shell is formed from a substantially flat sheet of material by a press moulding or vacuum moulding process and/or by folding.

11. A container as claimed in claim 3, further comprising a second shell attached to said lid.

12. A container as claimed in claim 3, wherein said base portion, hinge portion, and lid portion are formed from a single substantially flat folded sheet of paperboard and the shell is made of pressed paperboard.

13. A loaded container comprising a tray or blister pack having at least one blister and a container in which the tray or blister pack is received, the container comprising a base portion, a lid portion, and a hinge portion connecting the base portion to the lid portion and about which the lid portion and/or base portion are movable between an open configuration and a closed configuration, the base portion having a shell attached thereto for receiving the tray or blister pack, the shell having an open end, the tray or blister pack is received in the container for sliding movement through the open end between a storage position and one or more dispensing positions in a direction substantially parallel to said base portion, the shell having at least one detent disposed inside the shell such that the at least one detent is pressed on the at least one blister of the tray or blister pack during the sliding movement of the tray or blister pack so as to interfere slightly with the sliding movement while enabling the sliding movement, wherein the shell has a top wall opposed to the base portion and a pair of side walls connecting between the top wall and the base portion, each of the side walls extending substantially in the direction of the sliding movement, the at least one detent being provided on at least one of the side walls.

14. A loaded container as claimed in claim 13, in which the direction of sliding is either substantially parallel or substantially perpendicular to a hinge axis about which the lid and base portions are rotatable.

15. A loaded container as claimed in claim 13, wherein said base portion, hinge portion, and lid portion are formed from a single substantially flat folded sheet of paperboard and the shell is made of pressed paperboard.

16. A loaded container as claimed in claim 13, wherein said base portion, hinge portion, and lid portion are formed from a single substantially flat folded sheet of paperboard and the shell is made of thermo-formed plastic.

* * * * *